United States Patent [19]

Kopp

[11] Patent Number: 4,750,613

[45] Date of Patent: Jun. 14, 1988

[54] CLOSURE AND LIGHTER HOLDER FOR A PACK OF CIGARETTES

[76] Inventor: Yvette B. Kopp, 2209 Delta Queen, Violet, La. 70092

[21] Appl. No.: 920,464

[22] Filed: Oct. 20, 1986

[51] Int. Cl.[4] ..... B65D 51/28

[52] U.S. Cl. ..... 206/87; 206/259; 206/267; 220/212

[58] Field of Search ..... 206/85–89, 206/259, 267; 220/212

[56] References Cited

U.S. PATENT DOCUMENTS

| | | | |
|---|---|---|---|
| 1,862,518 | 6/1932 | Alland | 206/259 |
| 2,116,292 | 5/1938 | Wakefield | 206/87 |
| 3,178,016 | 4/1965 | Coats | 206/87 |
| 3,608,049 | 9/1971 | Kopp | 206/87 |
| 4,000,812 | 1/1977 | Pisarski et al. | 206/87 |
| 4,363,432 | 12/1982 | Warthen | 206/87 |

FOREIGN PATENT DOCUMENTS

| | | | |
|---|---|---|---|
| 1292446 | 3/1962 | France | 206/87 |

*Primary Examiner*—Jimmy G. Foster

*Attorney, Agent, or Firm*—Pravel, Gambrell, Hewitt Kimball & Krieger

[57] ABSTRACT

A closure and lighter holder for a pack of cigarettes and a lighter includes a first strip having a stop and a band for retaining a lighter, and a second strip for insertion through the top folds and sealing strip of a pack of cigarettes. The strip for closing the pack of cigarettes and the strip for holding the lighter are pivotally connected.

2 Claims, 1 Drawing Sheet

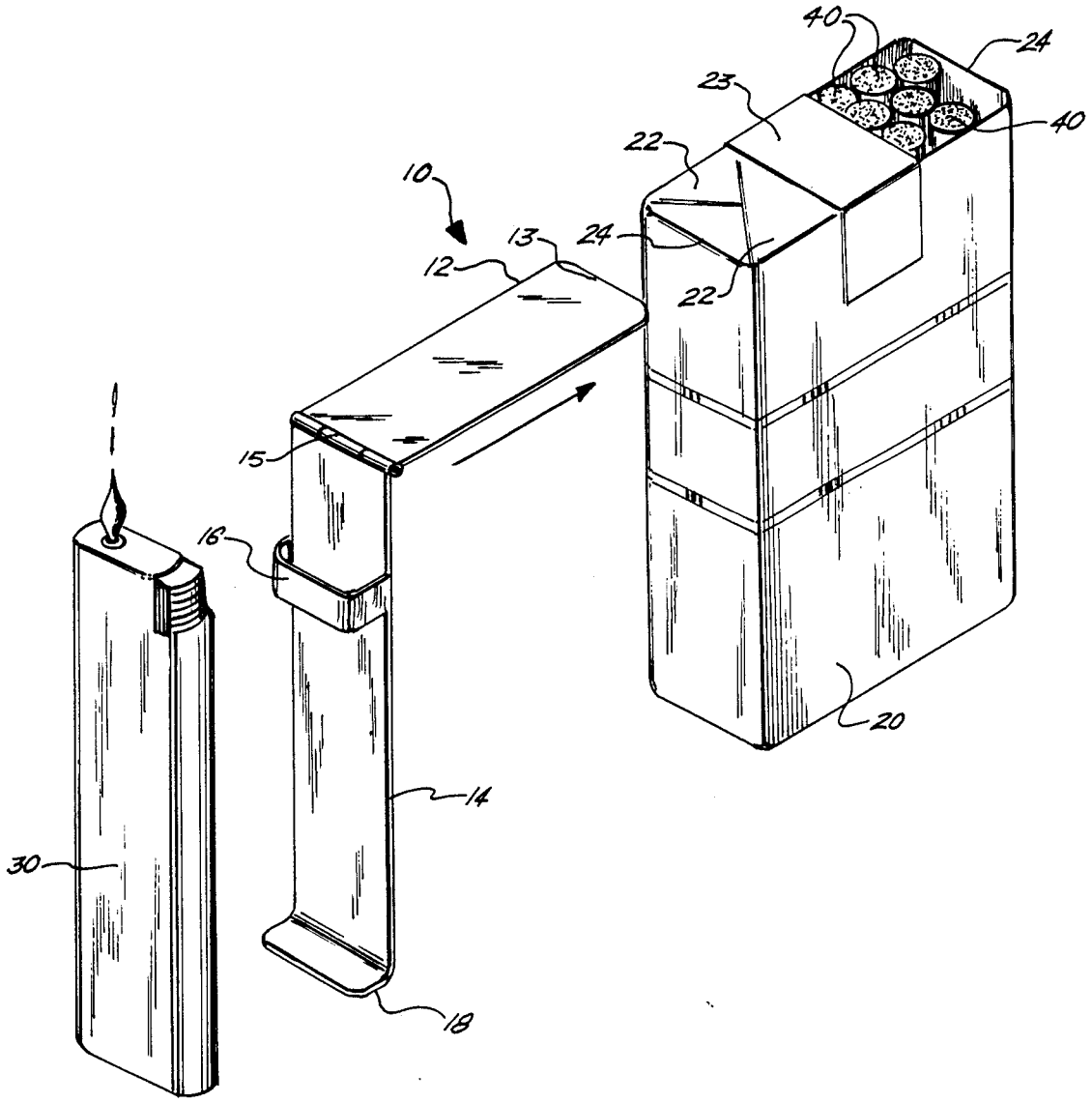
40
24
23
40
22
10
13
24
12
22
15
16
20
14
30
18

CLOSURE AND LIGHTER HOLDER FOR A PACK OF CIGARETTES

BACKGROUND OF THE INVENTION

The invention relates generally to smoking conveniences, and more particularly to an improved closure and lighter holder for a pack of cigarettes.

The present invention is an improvement over my prior invention for which U.S. Pat. No. 3,608,704 was issued, and is now cited as a reference with the prior art cited therein.

The present invention teaches a slidable top closure, for an opened pack of cigarettes, hinged to a cigarette lighter holder for more convenience in obtaining and lighting a cigarette and for a better weight distribution of the closure-holder and cigarette pack and also prevents the open end of the pack from being down to leak loose tobacco into pockets and pocketbooks.

SUMMARY OF THE INVENTION

It is an object of the invention to provide a cigarette pack closure hinged to a cigarette lighter holder for better distribution of weight in use, transit, and package strength.

BRIEF DESCRIPTION OF THE DRAWINGS

The FIGURE is a three dimensional semi-exploded drawing viewed from the upper left and showing the invention intermediate a cigarette lighter and a soft twenty pack of cigarettes in assembly sequence.

DETAILED DESCRIPTION OF THE PREFERRED EMBODIMENT

Referring to the FIGURE, the invention 10 comprises a slidable closure strip 12 of the top of a pack 20 of cigarettes 40 and made of any suitable rigid material such as metal or plastic. Closure strip 12 is dimensioned to extend across the top and to the sides of the pack 20 and engage between the top folds 22 of the pack 20 and the sealing strip 23 for covering the contents of the pack 20 wherever the folded top has been removed. A cigarette lighter holder 14 comprises a strip of material similar to that of the closure strip 12, is pivotally connected to an end 15 thereof and defines a retaining band 16 adjacent the hinged end, and an orthogonal stop 18 at the other end.

In use, the closure strips free end 13 is inserted under the top folds 22 at the top of the pack 20 and the sealing strip 23 and is slidably pushed until the oppositely disposed ends 13 and 15 of the closure 12 are flush with the edges 24 of the pack 20 and the holder 14 is pivoted downward in contact with the pack 20 with the retainer band 16 and the stop 18 extending outwardly. A cigarette lighter 30 is inserted slidably, bottom end down, through the retainer band 16 and down to the stop 18.

The cigarette package 20 is opened adjacent the free end 13 of the closure 12 so that when the closure 12 is retracted the contents of the package 20 are obtainable through the top opening, and one of the cigarettes 40 is conveniently lightable by the immediately-at-hand lighter 30.

It should be noted that by mounting the lighter 30 on the pack's side, the weight of the lighter tends to make the pack 20 rest on that side to help keep the closable end closed and any loose tobacco to fall into the pack.

What is claimed is:

1. An improved closure and lighter holder for a pack of cigarettes and a lighter, comprising:

(a) a top closure strip means for slidably engaging between the folds and sealing strip of a cigarette soft pack and slidably opening and closing the pack wherever the folds have been removed partially;

(b) lighter holder strip means of the same material, width and thickness as said top closure strip means and pivotally connected, at a first end thereof, to an end of said top closure strip means for pivoting with respect to said top closure strip means to contact a side of a pack below the pivotal connection when said top closure strip means is engaged between the folds and sealing strip of a cigarette soft pack;

(c) retaining means mounted on said lighter holder strip means intermediate its respective ends and extending outwardly; and (d) orthogonal stop means, defined at a second end of said lighter holder strip means and extending outwardly, for, in combination with said retaining means, slidably mounting a lighter on said lighter holder strip means.

2. A closure and lighter holder for a pack of cigarettes and a lighter, comprising:

(a) a top closure strip means for slidably engaging between the folds and sealing strip of a cigarette soft pack and slidably opening and closing the pack wherever the folds have been partially removed;

(b) lighter holder strip means, connected at a first end thereof to an end of said top closure strip means, which contacts a side of a pack below the connection when said top closure strip means is engaged between the folds and sealing strip of a cigarette soft pack;

(c) retaining means mounted on said lighter holder strip means intermediate its respective ends and extending outwardly; and (d) orthogonal stop means, adjacent a second end of said lighter holder strip means and extending outwardly, for, in combination with said retaining means, slidably mounting a lighter on said lighter holder strip means.

* * * * *